US005231736A

United States Patent [19]

Hohenöcker et al.

[11] Patent Number: 5,231,736

[45] Date of Patent: Aug. 3, 1993

[54] COVER FOR THE ENDS OF ZIPPERS

[75] Inventors: Gert D. Hohenöcker, Karlsruhe; Ernst Roehl, Hildesheim, both of Fed. Rep. of Germany

[73] Assignee: DYNAT Gesellschaft fur Verschlusstechnik und Feinmechanik mbH, Hildesheim, Fed. Rep. of Germany

[21] Appl. No.: 865,798

[22] Filed: Mar. 30, 1992

Related U.S. Application Data

[63] Continuation of Ser. No. 514,140, Apr. 25, 1990, abandoned.

[30] Foreign Application Priority Data

Apr. 26, 1989 [DE] Fed. Rep. of Germany ..... 3913737

[51] Int. Cl.[5] ..... A44B 19/32

[52] U.S. Cl. ..... 24/389; 24/384; 24/387

[58] Field of Search ..... 24/387, 388, 382–384, 24/389

[56] References Cited

U.S. PATENT DOCUMENTS

| | | | |
|---|---|---|---|
| 2,521,174 | 9/1950 | Krupp | 24/389 |
| 2,753,609 | 7/1956 | Gossner | 24/384 |
| 2,928,155 | 3/1960 | Kallio | 24/389 |
| 3,030,683 | 4/1962 | Doelter | 24/384 |
| 3,990,130 | 11/1976 | Hattori | 24/384 |
| 4,604,775 | 8/1986 | Kusayama | 24/384 X |

FOREIGN PATENT DOCUMENTS

| | | | |
|---|---|---|---|
| 0114363 | 12/1983 | European Pat. Off. . | |
| 1037791 | 8/1966 | United Kingdom | 24/387 |
| 2190133 | 11/1987 | United Kingdom . | |

*Primary Examiner*—James R. Brittain
*Attorney, Agent, or Firm*—Collard & Roe

[57] ABSTRACT

A cover is provided for the ends of one or more zippers, especially gas-tight and liquid-tight zippers with ends that extend toward each other in a straight line or at a particular angle. The cover consists of a lower plate and an upper plate with the zipper tapes and chains clamped between them, a seal disposed between the lower plate and the upper plate, and a disengageable connector that secures the lower plate to the upper plate.

1 Claim, 2 Drawing Sheets

COVER FOR THE ENDS OF ZIPPERS

This is a continuation of copending application Ser. No. 07/514,140 filed on Apr. 25, 1990 abandoned.

BACKGROUND OF THE INVENTION

The invention concerns a cover for the ends of one or more zippers. More particularly, it relates to a cover for the ends of gas-tight and liquid tight zippers which ends extend toward each other in a straight line or at a particular angle.

It is often desirable for containers, tents, awnings, and other structures made from textiles or composite textiles to have openings of various types and for various purposes, e.g., manholes, windows, and similar openings, that can be opened and closed by removing and inserting matching fittings. The fittings can be made out of different materials, e.g., transparent plastic sheet or netting. These fittings of various materials can also become damaged, worn out, or scratched from use and handling or can undergo other deformations that render them unusable, at which time they must be removed and a new fitting of the same type inserted. This replacement process has heretofore involved considerable time and labor when the joint between the fitting, e.g., a pane of transparent plastic for a tent or awning, is permanent and tight. Providing the edges of the opening and of its associated fitting with one or more take-apart zippers has accordingly been proposed, whereby the fitting can be inserted into and removed from the opening by way of the zipper.

SUMMARY OF THE INVENTION

Accordingly, it is an object of the present invention to provide a cover for the ends of one or more zippers which extend toward each other in a straight line or at an angle.

It is a further object of the present invention to provide such a cover which affords a permanent connection between the zippers, covers up any gaps between the zippers that occur for reasons of space in installing or operating the zippers, and which simultaneously reliably seals off such gaps in zippers that are intended to be gas-tight or liquid-tight.

A more particular object of the present invention is to provide such a zipper cover, the components of which can be easily and completely disassembled and reassembled.

Certain of the foregoing and related objects are achieved according to the invention by the provision of a cover embodying the present invention for the ends of one or more zippers, especially gas-tight and liquid-tight zippers, with ends that extend toward each other in a straight line or at a particular angle. The cover includes a lower plate and an upper plate with the zipper tape and teeth clamped between them, a seal disposed between the lower plate and the upper plate, and a connector that secures the lower plate to the upper plate and that can be disengaged. As a result, all the components of the cover can be easily and completely disassembled and reassembled.

Preferably, the seal is made of an elastomeric material. It is also advantageous that the connector comprises a screw and a corresponding sleeve. Most desirably, the sleeve is formed as one piece with the lower plate.

In a preferred embodiment of the invention, the ends of the zippers lack a box component and the ends of the zipper chains that extend toward each other lack stops. Advantageously, the tapes of the zippers that extend toward each other overlap or are permanently secured to each other on each side of the teeth or chain. Since the cover extends toward the zipper chains, it is preferably adapted to bridge over and seal off, in a gas or liquid tight manner, the gaps between the chains, which are dimensioned to be large enough to allow the zipper slide to be inserted or removed.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE INVENTION

Figure 1:
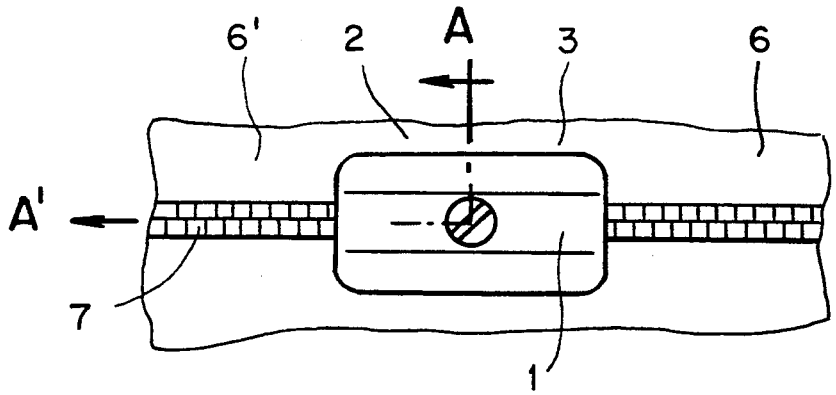
FIG. 1 a top view of a zipper cover embodying the present invention.

Referring now in detail to the drawings, zipper chains are shown that extend toward each other in a straight line. The end of one zipper 2 and the other end of the same zipper or the end of another zipper 3 extend toward each other and are connected by a cover 1 in the area where they are joined, i.e., in the vicinity of the chain(s) 7 and the tape 6, 6′ that adjoins each side of the chain 7. Cover 1 consists of a lower plate 4 and an upper plate 5 with tapes 6 and 6′ and chain(s) 7 clamped between them, a seal 8 disposed between lower plate 4 and upper plate 5, and a disengageable connector 9, preferably comprising a screw 10 and a mating sleeve 11, that secures lower plate 4 to upper plate 5. Sleeve 11 is formed as one piece with lower plate 4.

Figure 2:
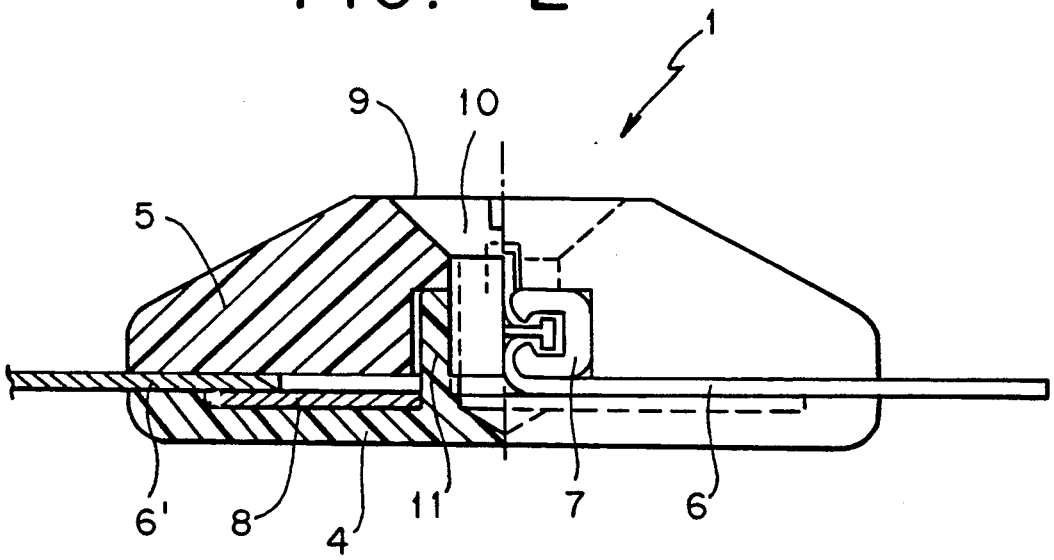
FIG. 2 is a side view, in part section and part elevation, of the zipper cover shown in FIG. 1, the part sectional view being taken along line A–A′ thereof.
Figure 3:
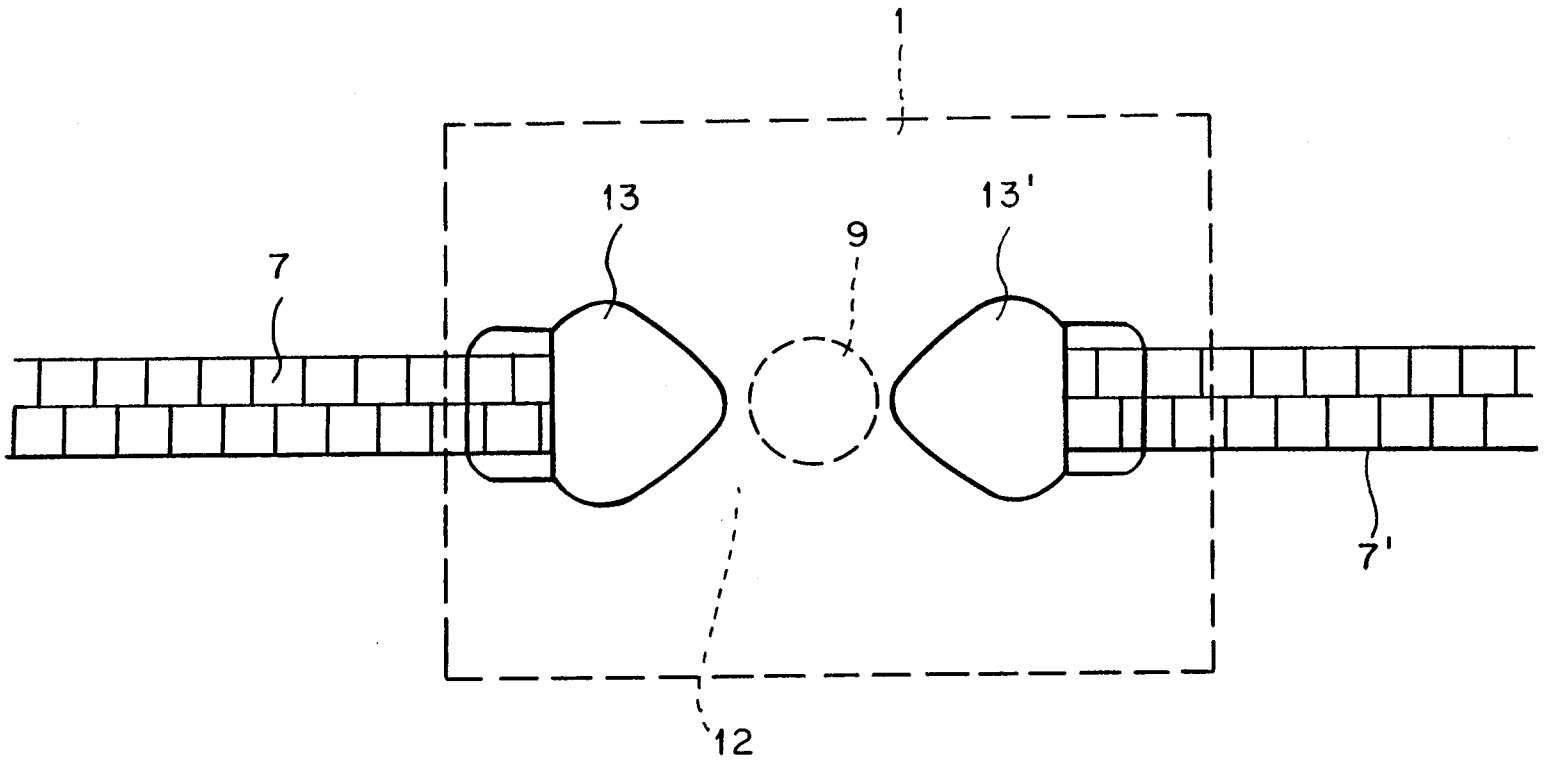
FIG. 3 is a top view of a zipper cover covering two zipper slide parts.

Proceeding from the structure of the invention represented in FIGS. 1 and 2, the condition when the cover is removed is now going to be described. According to FIG. 3, there is an overall gap 12 between the two zipper chains 7 and 7′. Since the zipper slide parts 13 and 13′ are arranged in the area of the gap 12 in the closed condition of these chains, it is important that the gap is large enough in all dimensions that removal and insertion of these slides is possible. In addition, if the connector element 9 is structured so as to comprise a screw and a sleeve, the gap must still leave room for the connector element 9 to pass through, after the slide parts 13 and 13′ have been inserted.

As a result of this cover construction, the components of the cover can be easily and completely disassembled and reassembled. In particular, if one desired to replace e.g., a defective awning light, from an opening, the cover would be disassembled, a fresh pane of transparent plastic sheet would be inserted by way of one or more zippers and the cover would be reassembled.

While only one embodiment of the present invention has been shown and described, it is obvious that many changes and modifications may be made thereunto without departing from the spirit and scope of the invention.

What is claimed is:

1. A cover for the ends of at least one zipper in combination with at least one zipper having ends, comprising:

a lower plate and an upper plate between which the ends of at least one zipper may be clamped;

a seal disposed between said lower plate and said upper plate said seal being made of an elastomeric material;

disengageable connecting means for securing said upper plate to said lower plate, which permits said cover to be completely disassembled and reassembled, said connecting means comprising a screw and a sleeve, and said sleeve being formed as one piece with said lower plate;

wherein the ends of the at least one zipper have chains that extend toward each other;

said at least one zipper having a zipper slide;

wherein said cover which extends toward the zipper chains, is adapted for bridging over and sealing off in a gas tight or liquid tight manner, gaps between the zipper chains that are dimensioned to be large enough to allow the zipper slide to be inserted or removed; by said upper plate, lower plate and said screw being capable of completely covering on both faces the ends of said at least one zipper and said zipper slide; and wherein said at least one zipper has overlapping tapes that extend toward each other or are permanently secured to each other on each side of the chains.

* * * * *